United States Patent [19]

Fischer

[11] 4,256,042

[45] Mar. 17, 1981

[54] RAILWAY HOPPER CAR SLIDING GATE LOCK

[75] Inventor: Robert T. Fischer, Homewood, Ill.

[73] Assignee: Miner Enterprises, Inc., Geneva, Ill.

[21] Appl. No.: 81,763

[22] Filed: Oct. 4, 1979

[51] Int. Cl.[3] ..... B61D 7/20; B61D 7/22; B61D 7/26

[52] U.S. Cl. ..... 105/282 P; 105/308 C

[58] Field of Search ..... 105/282 R, 282 P, 308 C

[56] References Cited

U.S. PATENT DOCUMENTS

| | | | |
|---|---|---|---|
| 2,142,236 | 1/1939 | Campbell | 105/282 P |
| 2,749,851 | 6/1956 | Dorey | 105/308 C |
| 3,035,530 | 5/1962 | Meyers et al. | 105/282 R X |
| 3,683,820 | 8/1972 | Floehr | 105/282 R |
| 3,707,126 | 12/1972 | Nester | 105/282 P |

*Primary Examiner*—Howard Beltran
*Attorney, Agent, or Firm*—Darbo & Vandenburgh

[57] ABSTRACT

A plate welded to what is the leading edge of the slide gate door, as the slide gate door would move in the opening direction, engages a portion of the peripheral face of a cam. The plate is above the supports on which the gate rides. In the event that a force is applied to the door urging the door in the opening direction, that portion of the cam cams the distal side of the plate toward those supports, whereby the plate acts as a spring resisting that force and in preventing the door significantly moving in the opening direction. The cam can be rotated to another position at which the plate and door are free to move below it to the opened position.

2 Claims, 6 Drawing Figures

RAILWAY HOPPER CAR SLIDING GATE LOCK

BACKGROUND AND SUMMARY OF THE INVENTION

The present invention is an improvement is a locking device for preventing an unintended movement of the slide gate door of a railway hopper car from the closed to the open position. Various devices for accomplishing this purpose are known to the art, as for example, U.S. Pat. Nos. 2,142,236, 2,749,851 and 3,707,126.

One advantage of the present invention as compared to the known devices is that the locking device has some resiliency in resisting a force tending to move the slide gate door in the opening direction. Railway cars are subjected to numerous impact forces, some of which are quite severe. For example, when a railway car moves down the hump in a classification yard it likely will impact upon other cars on the track ahead of it and the impact can be exceedingly forceful. While shock absorbers are built into the coupling units of cars, still there are severe shock loads within the body of the car and its content. Such shock loads can affect the position of the slide gaste door due to its inertia, with the slide gate door thus impacting against its locking device (depending upon the sense of the shock force). The present invention makes available a construction in which there need be no play, or lost motion, when the slide gate door is locked closed, and which includes a spring element to absorb shock forces applied in the sense of the door opening direction.

Another advantage of the invention is the simplicity available to obtain a good fit during the course of manufacture. As compared to the available state of the manufacturing art, the manufacturing techniques employed in producing railroad hopper cars and their components are not very sophisticated, perhaps even crude. That is, in the main the components are not made with very close tolerances because such criticality is quite unnecessary and the expense of achieving close tolerances is unjustified. The application is such that the monetary savings achieved by using forming and fabricating techniques which do not result in close tolerances is important. Through the use of the present invention it is quite simple for the workers who are putting the car together to make adjustments necessary to achieve a good fit even though the tolerances up to that point have been sufficiently loose such that it would be only by accident that a good fit was achieved.

Further objects and advantages will become apparent from the disclosure herein of an embodiment of the invention.

In the present invention a plate is imposed between the leading (in the opening sense) edge of the slide gate door and a cam pivotally mounted on the car frame, which plate is positioned and arranged to serve as a spring. The plate is welded to that edge of the door and the plate's distal side is located slightly above the door supports. That part of the cam face that engages the distal side of the plate is arranged to cam the plate toward those supports, whereby the plate is blocked against significant movement in the door opening direction, and serves as a spring resisting forces applied in the sense of the door opening direction.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or f urther improvements.

Figure 1:
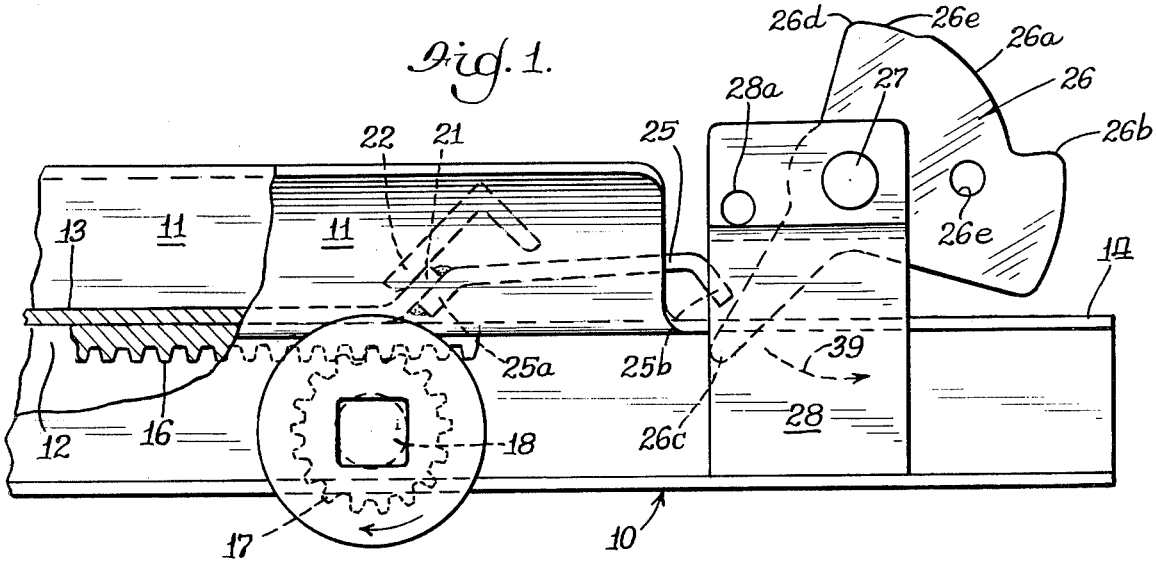
FIG. 1 is an elevational view, partially broken away, of a segment of a railway hopper car, which segment includes a portion of the slide gate door, and shows an embodiment of the invention in the door unlocked position.
Figure 3:
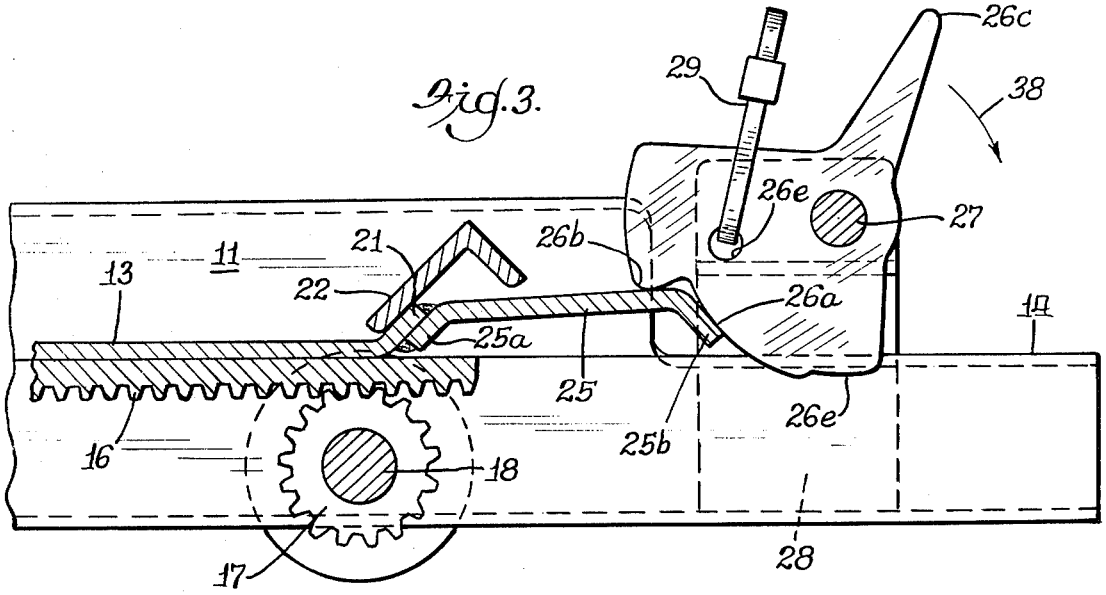
FIG. 3 is a view similar to FIG. 1 but showing the door in the closed and locked position.

A railway hopper car slide gate will include a frame, generally 10. The loading space or bins (not shown) of a railway hopper car having a downwardly extending chute through which the lading can be discharged. At the bottom of the chute are the angled sides 11 about the opening 12 through which the car's contents are discharged. A slide gate door 13 is employed to close off this opening. This door rests upon supports 14 formed by a part of the frame 10. To move the door along the supports between the closed position and the opened position, the door has a pair of racks 16 secured to the underside thereof. Each rack is engaged by a pinion 17 secured to a shaft 18 in the frame. Means such as a handle 19 is provided for rotating the shaft 18 by use of a removable lever **19*a* or power tool and thus causing the pinion, by engagement with the rack, to move the door in the opening or closing direction. Various means are employed to provide a seal about the gate when it is in the closed position. Such means may include an upturned flange or edge 21 which abuts a stop 22 when the door is in the closed position (FIGS. 1 and 3**).

As thus far described, the structure is conventional and the details thereof are merely for the purpose of illustration.

Figure 2:
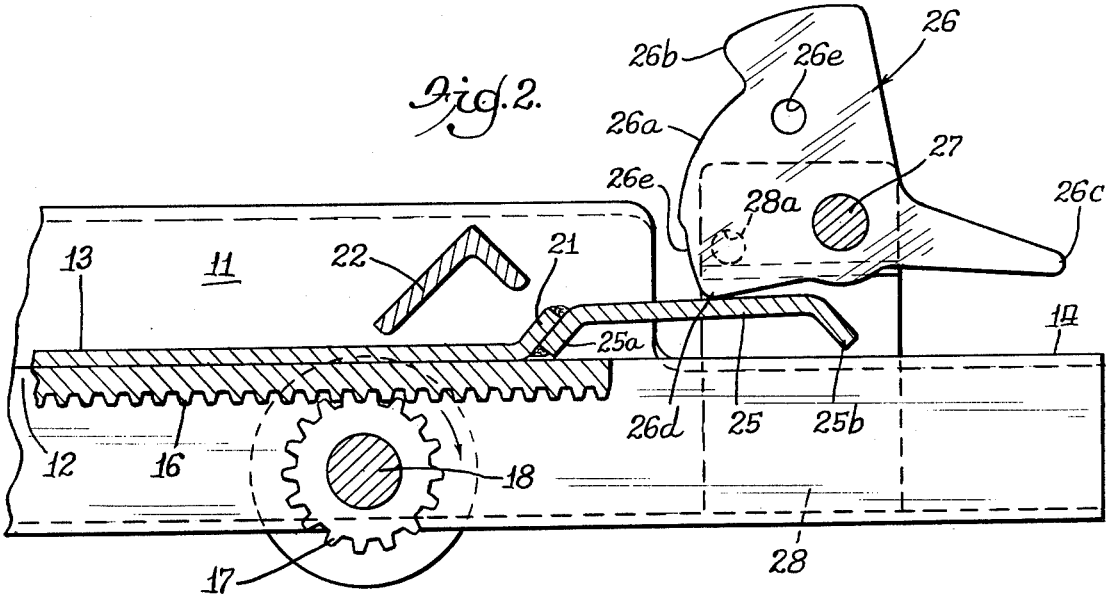
FIG. 2 is a view similar to FIG. 1 showing the door partially open.

In the present invention a plate 25 is employed. The plate has a proximal side **25*a* which is welded to that edge of the gate 13 which is the leading gate side as the gate moves in the opening direction, i.e., to edge 21. The positioning of the plate is such that the distal side 25*b* of the plate is a short distance (e.g., one-quarter of an inch or so) above the door supports 14 when the plate is in the free condition (FIGS. 1 and 2**).

This plate cooperates with at least one cam 26 but preferably with a pair of cams 26 to lock the slide gate door in the closed position. Only one of cams 26 is illustrated, but normally there would be a second one at the opposite side of the door from that illustrated. Both of these cams are secured to a shaft 27 for movement in unison. Shaft 27 is journaled in brackets 28 forming a part of the frame 10. This cam has a peripheral face (best seen in FIG. 5), significant portions of which are identified in the drawings as **26*a–d*. The cam has an opening 26*e* which, when the door is locked closed (FIG. 3), registers with an opening 28***a* in bracket 28. This permits a car seal 29 to be inserted through both openings. Thus the seal must be broken before the gate may be opened and the presence of an unbroken seal signifies that the car's contents are intact.

Figure 4:
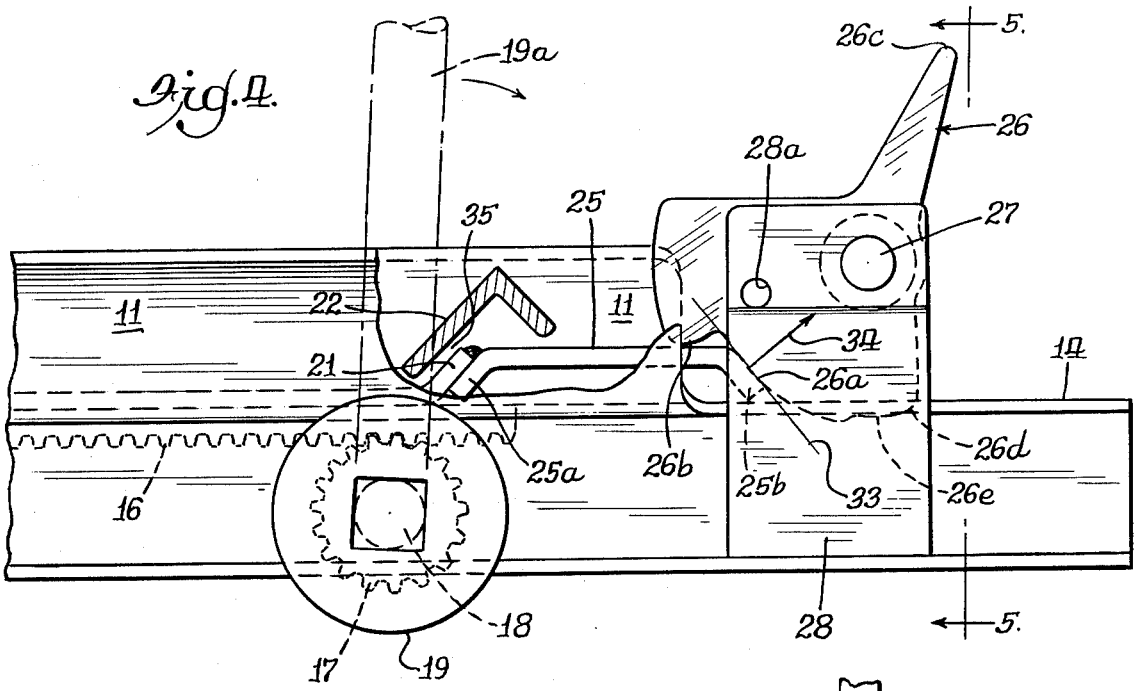
FIG. 4 is a view similar to FIG. 3 but showing, in exaggerated form, what occurs when a force is applied to the slide gate door in the sense of urging the door toward the open position.

FIG. 3 illustrates the door in the closed and locked position. At this time the distal side 25*b* of the plate is bearing against the portion 26*a* of the cam face. This prevents the door from significantly moving in the opening direction (i.e., toward the right in the drawings). Assuming that a strong force would be applied to the slide gate door tending to move the door in the opening direction, the cam's reaction to that force is almost in line with the axis of shaft 27. In FIG. 4 the line 33 represents a tangent to the curve of the portion 26*a* of the cam at the area of contact between the cam face and plate edge 25*b*. Line 34 is normal to the tangent line 33 and represents the force that the edge 25*b* is applying against the cam (the reaction force of the cam being diametrically opposite).

FIG. 4 illustrates, with some exaggeration, the situation that occurs when an extremely strong force is applied to the door 13 in the sense of the door opening direction. The side 25*b* of the plate is cammed by the portion 26*a* of the cam in a downward direction with that movement ultimately being prevented by edge 25*b*'s contact with the supports 14. The plate is now flexed and acting as a spring. This spring action will permit a limited amount of movement of the slide gate door in the opening direction, resulting in the gap 35 between the edge 21 of the door and the stop 22. For emphasis it will be repeated, that FIG. 4 is an exaggerated illustration. The stiffness of plate 25, along with the friction occurring in the camming, is such that under normal conditions the movement of the slide gate door and the plate to the right will terminate before the side 25*b* of the plate comes into contact with the support 14. Of course, when the force causing the impetus toward door dislocation is removed, the spring action of the plate 25 will return the door and plate to the FIG. 3 position.

Assuming that the door is to be opened to permit the car's contents to be discharged through the opening 12, the first step would be to remove seal 29. The cams 26 are then rotated to the FIG. 1 position. This may be done by grasping the projection that defines portion 26*c* and rotating it clockwise from the FIG. 3 position as indicated by arrow 38. In the normal manner shaft 18 is now rotated clockwise forcing slide gate door 13 and plate 25 to the right. As this is done, the distal side 25*b* of the plate contacts the projection forming portion 26*c*. This rotates the cam counterclockwise as indicated by arrow 39. It will be noted that the part of the cam forming portions 26*b*, 26*a* and 26*d* is substantially larger, and thus substantially heavier, than is the remainder of the cam. As this heavier part of the cam gets to the left of a plane vertically through the axis of shaft 27 (during the opening movement of the slide gate door), the weight thereof causes the cam to flop in a counterclockwise direction so that the portion 26*d* of the cam then is resting on the plate 25 as illustrated in FIG. 2. The cam essentially remains in this position during the remainder of the opening of the door, and also as the door returns to the FIG. 2 position. As the door continues to move in the closing direction (to the left) from the FIG. 2 position it will ultimately get to a location at which the distal side 25*b* of the plate passes the portion 26*d* of the cam. When this occurs, the weight of the heavier side of the cam urges the cam in the counterclockwise direction so that the cam automatically rotates toward the FIG. 3 position. The cam 26 has surface 26*e* which is arranged so that it is radially nearer to cam pivot point at shaft 27 than surface 26*a*. This allows the cam to self-engage to this position when the door is closed. To engage the cam to the fully closed position, as shown in FIG. 3, with cam surface 26*a* and plate 25 in contact, an external counterclockwise torque is required on the cam 26. This engaging external torque preloads the lock by deflecting plate 25 partially down. Ultimately the portion 26*b* of the cam will be resting on the upper surface of the plate 25. The door is again locked in the closed position (whether or not a seal 29 or its equivalent is employed).

From the foregoing description it is believed that those skilled in the art will be apprised of the simplicity available to produce a satisfactory fit of the locking device and the slide gate door even though the components are not formed to very precise tolerances. For example, a jig may be employed to hold door 13 and plate 25 while they are welded so that the location of edge 25*b* is reasonably accurate. Similarly, a jig may be employed in the mounting of brackets 28 so that shaft 27 will have the desired position. If even through the use of such jigs (or if even less accurate positioning of parts is employed) the desired final fit is not achieved, it is a simple matter to make plate 25 slightly oversize and then grind off a small portion of edge 25*b* after final assembly and thus achieve the desired fit.

Figure 6:
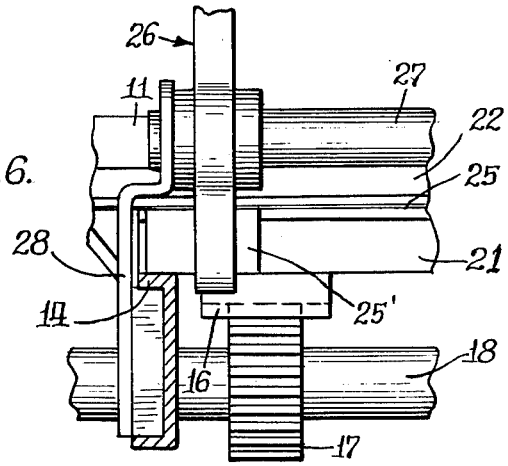
FIG. 6 is a view corresponding to FIG. 5, but illustrating a modification.
Figure 5:
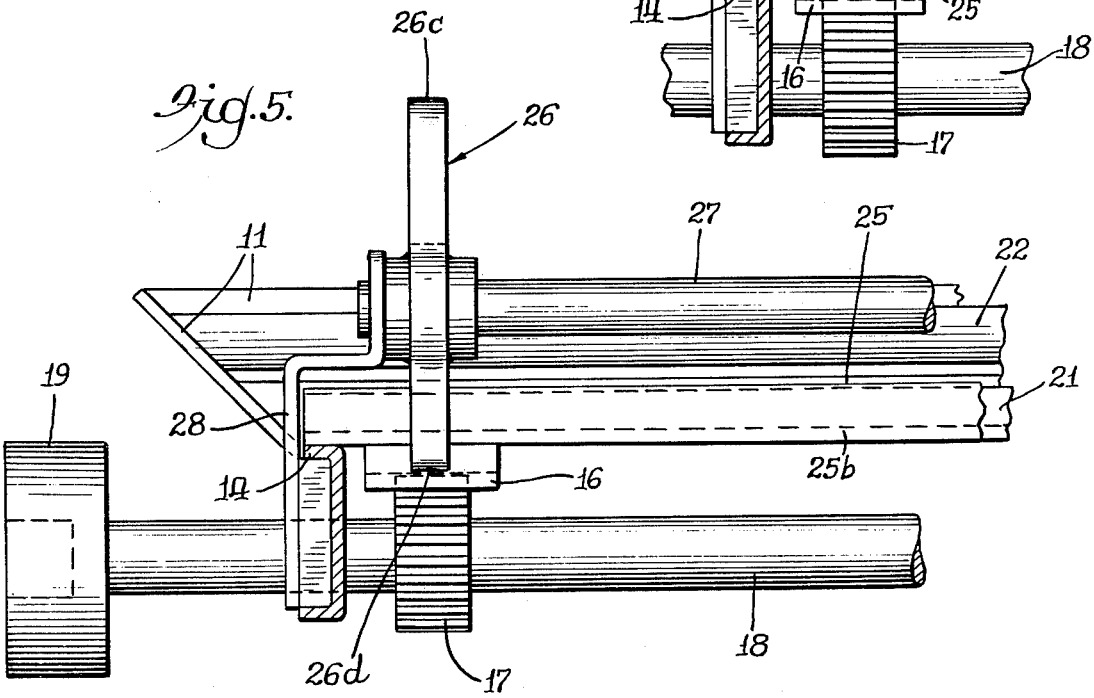
FIG. 5 is a partial section as viewed at line 5—5 of FIG. 4.

Although plate 25 is shown in FIG. 5 as a one piece unit extending transversely, relative to the direction of travel of the gate, and being engageable with one or more of the cams as herein described, economics of manufacture may require the plate to be in several parts, each part approximately one inch wide in the transverse dimension to constitute a finger and each part being engageable with a cam. Such a partial plate (or finger) is shown at 25' in FIG. 6.

I claim:

1. A slide gate for a railway hopper car having a discharge opening, a slide gate door for said opening, a frame including generally horizontal support means upon which the door rides when moving between a first position at which it is below and closing said opening and a second position at which it is located at one side of said opening, means on said frame and engaging said door for moving said door between said positions, said door having an edge which leads the remainder of the door when the door is moving in the direction of the first to the second position, and means releasably engaging said door at said edge for preventing said edge and thus said door from moving in said direction from said first position, the last mentioned means being characterized by:

a spring plate having distal and proximal sides, said proximal side being affixed to said door at said edge, said distal side being in said direction from said proximal side and spaced a short distance above said support means; and a cam pivotally secured to said frame for rotational movement about an axis, said axis being located at an elevation farther above said support means than is said plate, said cam having a cam face with a plurality of portions, with the door in the first position and in one rotational position of said cam one of said portions engaging said distal side and, in response to a force applied to said door in the sense of forcing said door in said direction, camming said distal side in the direction of said support means whereby the distal side of the plate acts as a cantilever spring resisting said force and with the cam blocks any significant movement of said door in said direction, and in another rotational position of said cam all of said portions being above said plate and door whereby they can be moved in said direction.

2. A slide gate as set forth in claim 1, wherein the size of said plate, as measured parallel to said edge, is substantially smaller than the length of said edge whereby said plate is in the form of a finger projecting from said edge.

* * * * *